US007823821B2

(12) United States Patent
Strauss et al.

(10) Patent No.: US 7,823,821 B2
(45) Date of Patent: Nov. 2, 2010

(54) DISTRIBUTOR PLATE

(75) Inventors: Graham Strauss, New South Wales (AU); Peter Hale, New South Wales (AU)

(73) Assignee: Crushing & Mining Equipment Pty Ltd (AU)

( * ) Notice: Subject to any disclaimer, the term of this patent is extended or adjusted under 35 U.S.C. 154(b) by 1149 days.

(21) Appl. No.: 10/532,165

(22) PCT Filed: Oct. 24, 2002

(86) PCT No.: PCT/AU02/01446

§ 371 (c)(1),
(2), (4) Date: Sep. 20, 2005

(87) PCT Pub. No.: WO2004/037424

PCT Pub. Date: May 6, 2004

(65) Prior Publication Data

US 2006/0138265 A1 Jun. 29, 2006

(51) Int. Cl.
*B02C 19/00* (2006.01)

(52) U.S. Cl. ..... 241/275

(58) Field of Classification Search ..... 241/5, 241/275

See application file for complete search history.

(56) References Cited

U.S. PATENT DOCUMENTS 3,970,257 A * 7/1976 MacDonald et al. ..... 241/275
4,889,428 A 12/1989 Hodson
5,431,348 A 7/1995 Orsolini et al.
5,620,145 A 4/1997 Masuda
5,662,282 A 9/1997 Meyer
6,382,536 B1 * 5/2002 Lusty et al. ..... 241/5
6,416,000 B1 * 7/2002 Lusty et al. ..... 241/275
6,685,794 B2 * 2/2004 Shinohara et al. ..... 156/273.1

FOREIGN PATENT DOCUMENTS

WO WO 01/30501 A1 5/2001

OTHER PUBLICATIONS

International Preliminary Examination Report, PCT/AU2002/001446, dated Feb. 11, 2005.
International Search Report, PCT/AU2002/001446, dated Dec. 12, 2002.

* cited by examiner

*Primary Examiner*—Jimmy T Nguyen
(74) *Attorney, Agent, or Firm*—Myers Bigel Sibley & Sajovec, P.A.

(57) ABSTRACT

A distributor plate (10) is shown for use in an impelling rotor of a vertical shaft impactor (14). Typically the impelling rotor is a chamber (12) arranged to rotate about a vertical axis A-A. Feed materials for breakage are gravity-fed into the rotating chamber (12). These materials strike the rotating distributor plate (10) which is located at the base of the rotor chamber (12). The plate has a substantially planar single-piece upper surface (24) onto which the feed materials are received. This substantially flat surface (24) facilitates rapid and easy expulsion of feed materials there across and out of the rotor chamber (12). The plate shown is a circular disc made of metal carbide. Use of a single-piece upper surface of the distributor plate (10) also will not result in the development of preferential wear sites at corners, edges, join lines etc, as can happen with the known distributor plates.

14 Claims, 6 Drawing Sheets

DISTRIBUTOR PLATE

RELATED APPLICATION

This application claims priority from International Application No. PCT/AU2002/001446, filed Oct. 24, 2002, the disclosure of which is incorporated herein by reference in its entirety. The above International Application was published in the English language on May 6, 2004, as PCT Publication WO 2004/037424.

FIELD OF THE INVENTION

The present invention relates to the components of an impactor apparatus for breaking feed materials passed thereinto. In one form the invention relates to a feed distribution plate for use in a rotating shaft impactor and will primarily be described with reference to this context. It should be remembered, however, that the components of the invention have broader use in feed distribution applications in all manner of crushing or breaking equipment.

BACKGROUND OF INVENTION

Impactors for breakage of materials are known in the art. Such apparatus includes a rotating chamber arranged to rapidly rotate about an axis. Feed materials such as rock, gravel, mineral ores and the like are passed into the rotor chamber via an inlet and contact a distributor plate located on one side of the chamber opposite to the feed material inlet. The materials slide across the distributor plate and are ejected sideways to impact against the surrounding walls of the impactor, and are thereby attritioned. The rotor chamber can become blocked when too much feed or feed containing large particles chokes the chamber, necessitating stopping of the apparatus. Due to the nature of the feed materials and the duty required of the apparatus, the distribution plate surface is normally made of a high strength alloy metal and this is usually an expensive item. In use the distribution plates are subjected to significant and uneven wear.

SUMMARY OF THE INVENTION

In a first aspect the present invention provides a distributor plate for an impelling rotor of a rotating shaft impactor, where the impelling rotor is a chamber arranged in use to rotate about an axis and to radially eject material received therein through one or more ejection ports in a side wall of the chamber, the distributor plate being in use held in a fixed position with respect to the impelling rotor, wherein the distributor plate includes a body and a single wear element only, the single wear element being positioned on the body to alone cover an outer surface of the body onto which the material would otherwise be received. Such a wear element can reduce the severity of abrasive wear experienced by the body due to the movement of material across the distributor plate and thus prolong the time before replacement of the entire distributor plate is required. The use of a single wear element also prevents the development of preferential wear sites at corners, edges, join lines etc, which occurs with the known distribution plates that have a two or more part surface.

Preferably the outer surface of the wear element is substantially planar. A substantially flat surface facilitates rapid and easy expulsion of material from the rotor chamber. The use of the substantially flat distributor plate ensures that the centre of the rotor is less liable to blockage during use because the volume of available space in the rotor chamber is large enough to allow an easier passage of higher volumes of feed material, or feed materials which have a coarser overall particle size.

Preferably a surface of the wear element is affixed to a mating surface of the body. Most preferably the mating surface is substantially planar.

Preferably the wear element is a plate. Most preferably the wear element is a circular disc.

Preferably the wear element is made of a wear resistant material.

Preferably the body includes a projection at its peripheral edge which is used to locate the wear element on the body. Most preferably the projection is a peripheral lip.

Preferably the wear element is spaced from the body by one or more spacers arranged between opposing mating surfaces of the body and the wear element so that, when the wear element is attached to the body by use of an adhesive substance, the spacer(s) provide a predetermined depth of the adhesive substance between the body and the wear element. The predetermined depth of an adhesive substance is typically the optimum amount of adhesive recommended by the adhesive manufacturer.

Preferably one such spacer is a projecting ring on the body, concentric with a central axis of the body and inset from the peripheral edge of the body.

Preferably a second peripheral edge of the body is bevelled in at least one position, the bevelled edge adapted for the insertion of a levering tool to facilitate movement of the distributor plate. Preferably the entire second peripheral edge is bevelled so that a levering tool such as a screwdriver can be inserted in any location on the circumference to facilitate lifting and grasping of the distributor plate by hand for rotation into a different wear position, or for servicing or replacement entirely.

In a second aspect the present invention provides a distributor plate for an impelling rotor of a rotating shaft impactor, the distributor plate including a wear element positioned on a body, the wear element spaced from the body by one or more spacers arranged between facing surfaces of the body and the wear element so that, when the element is attached to the body by use of an adhesive substance, the spacer(s) allow for a predetermined depth of the adhesive substance between the body and the wear element.

In a third aspect the present invention provides a distributor plate for an impelling rotor of a rotating shaft impactor, where the impelling rotor is a chamber mountable via a coupling element to a shaft of the impactor and arranged in use to rotate about an axis and to radially eject materials received therein through one or more ejection ports in a side wall of the chamber, wherein the distributor plate has a basal spigot, with a cavity in the spigot for receiving the coupling element therein in use. The cavity can be of any shape or dimension to suit the particular requirements of a coupling bolt or any other fastening device used to attach the rotor chamber to the shaft.

In a fourth aspect the present invention provides a distributor plate for an impelling rotor of a rotating shaft impactor, where the impelling rotor is a chamber arranged in use to rotate about a rotating axis and to radially eject materials received therein through one or more ejection ports in a side wall of the chamber, wherein at least part of a peripheral edge of the distributor plate is bevelled for the insertion of a levering tool to facilitate movement of the distributor plate.

In a fifth aspect the present invention provides a distributor plate for an impelling rotor of a rotating shaft impactor, where the impelling rotor is a chamber arranged in use to rotate about a rotating axis and to radially eject materials received therein through one or more ejection ports in a side wall of the chamber, the distributor plate including a single wear element positioned on a body to alone cover an outer surface of the body and either of an opposing surface of the body or the wear element including a projection which locates the wear element on the body.

Preferably the projection of the fifth aspect is located at the edge of the body and around its periphery. Most preferably the projection is an upwardly projecting circumferential lip or a partial circumferential lip.

In a sixth aspect the present invention provides a mounting for supporting a distributor plate in an impelling rotor of a rotating shaft impactor, where the impelling rotor is a chamber arranged in use to rotate about an axis and to radially eject materials received therein through one or more ejection ports in a side wall of the chamber, the distributor plate having a multi-sided basal spigot receivable in a multi-sided recess in the mounting, wherein the number of sides of the recess is a multiple greater than one of the number of sides of the spigot. It is therefore possible to move (rotate) the distributor plate with respect to the mounting into multiple "wear" positions to spread the abrasive wearing evenly over the distributor plate over time, rather than only having a limited number of grooves worn thereinto. Such a facility thus enables thinner wear plates to be used in such apparatus which reduces the unit cost and weight of the distributor plates.

Preferably the mounting is incorporated in a plate on which the distributor plate rests.

Alternatively the mounting is incorporated in a rotatable shaft of the rotating shaft impactor.

Preferably the recess of the sixth aspect is a twelve-pointed star shaped hole having twenty four sides and the basal spigot has six sides.

In a seventh aspect the present invention provides an impelling rotor of a rotating shaft impactor including a distributor plate as defined in any one of the first five aspects.

In an eighth aspect the present invention provides an impelling rotor of a rotating shaft impactor including a mounting as defined in the sixth aspect.

In a ninth aspect the present invention provides a rotating shaft impactor including a distributor plate as defined in any one of the first five aspects.

In a tenth aspect the present invention provides a rotating shaft impactor including a mounting as defined in the sixth aspect.

BRIEF DESCRIPTION OF THE DRAWINGS

Notwithstanding any other forms which may fall within the scope of the present invention, preferred forms of the invention will now be described, by way of example only, with reference to the accompanying drawings in which.

DETAILED DESCRIPTION OF THE INVENTION

Figure 1:
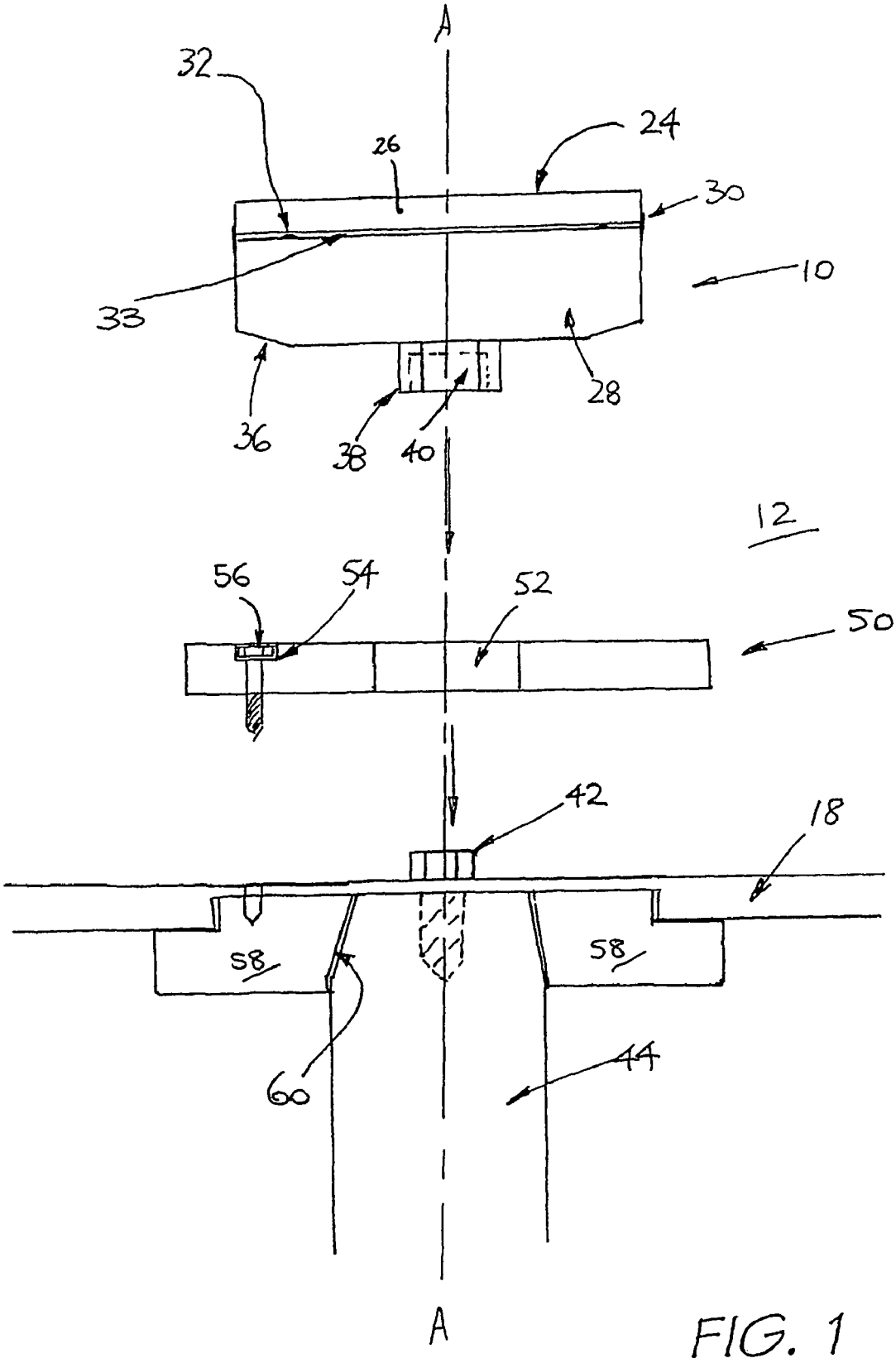
FIG. 1 shows an exploded partly sectioned side view of one embodiment of a distributor plate for an impelling rotor of a vertical shaft impactor in accordance with the invention.
Figure 2:
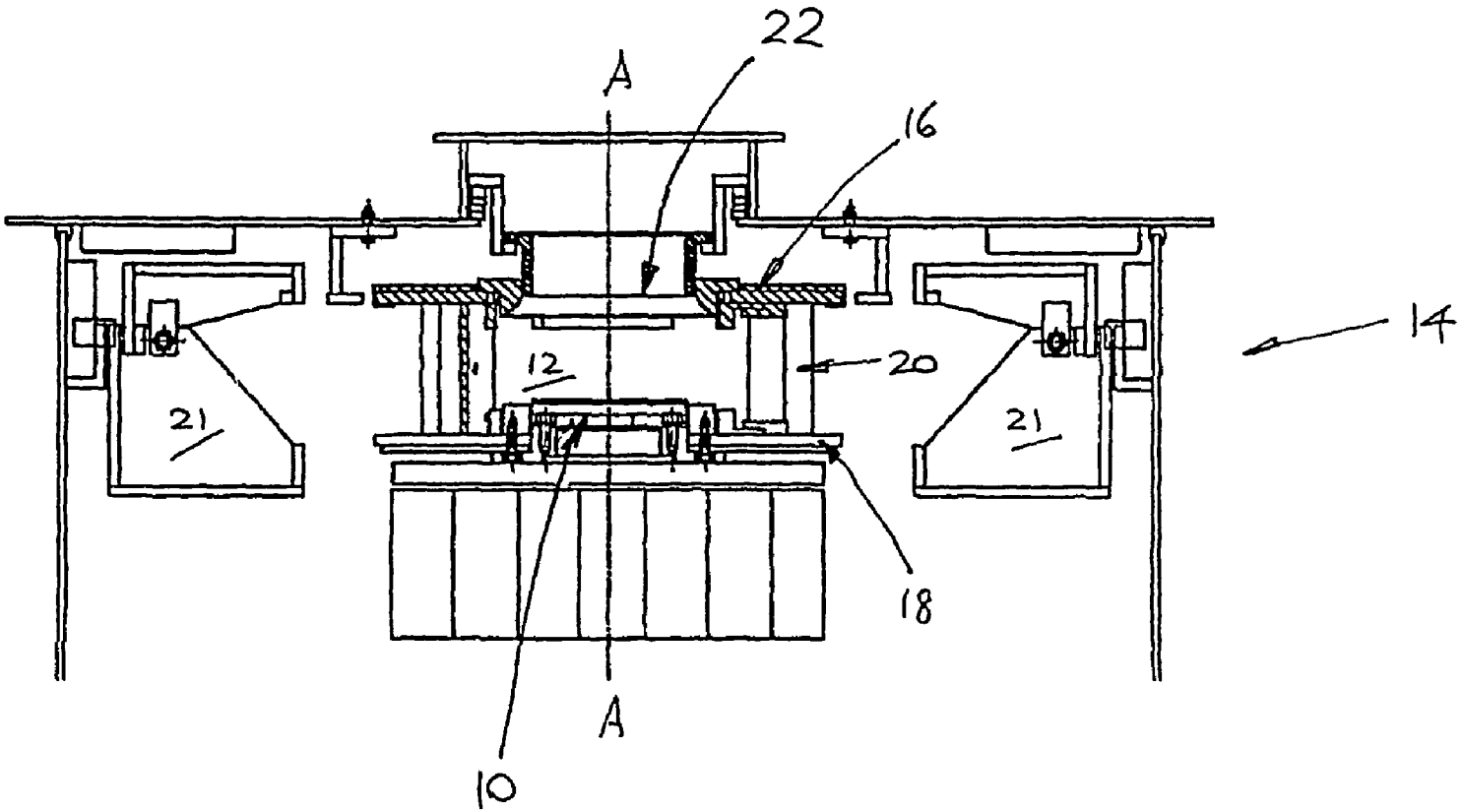
FIG. 2 shows a side view of the embodiment of FIG. 1 when assembled in a vertical shaft impactor machine.
Figure 3:
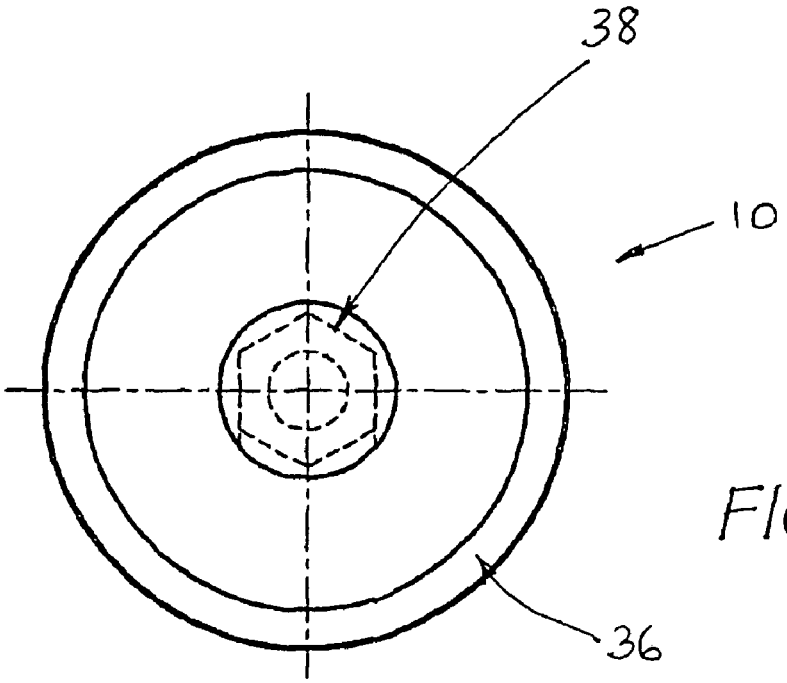
FIG. 3 shows an plan view of one embodiment of a distributor plate in accordance with the invention.
Figure 4:
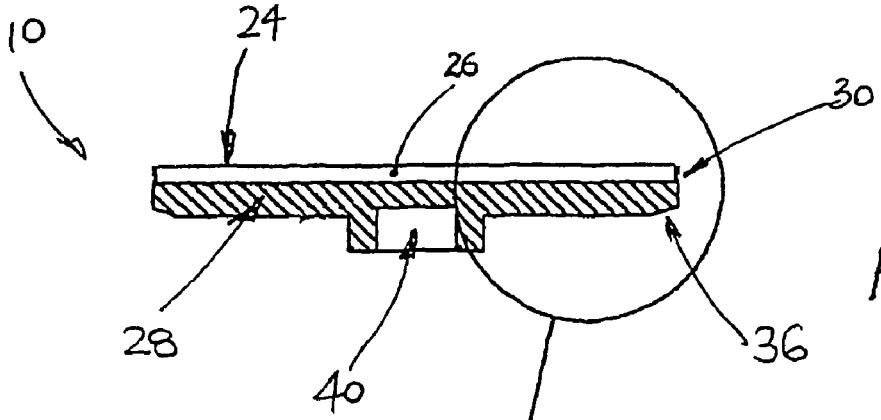
FIG. 4 shows a sectioned side view of the embodiment of FIG. 3.
Figure 4A:
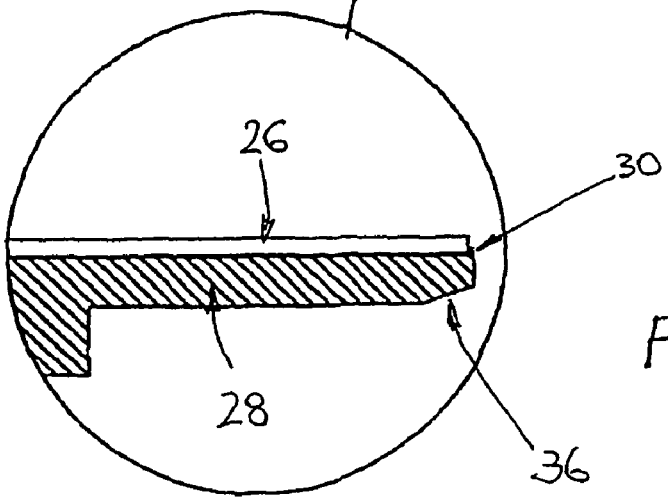
FIG. 4*a* shows a detail of the embodiment of FIG. 4.
Figure 5:
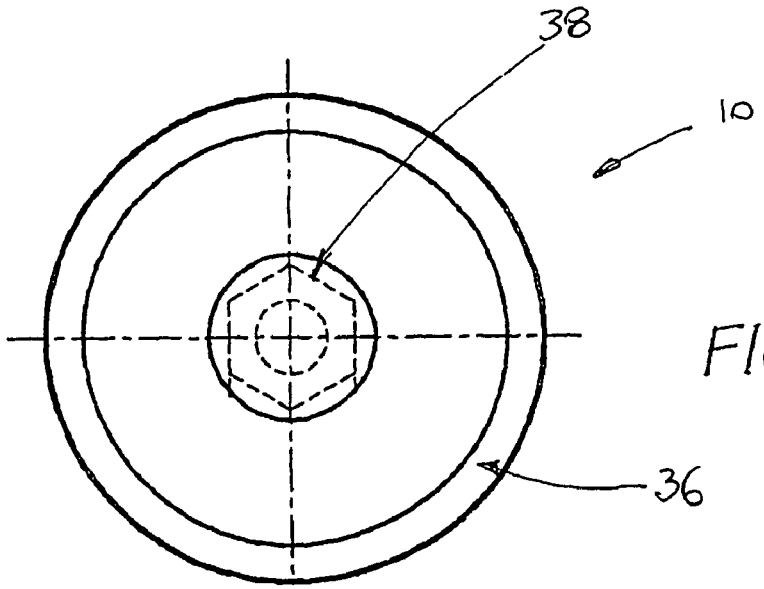
FIG. 5 shows an plan view of another embodiment of a distributor plate in accordance with the invention.
Figure 6:
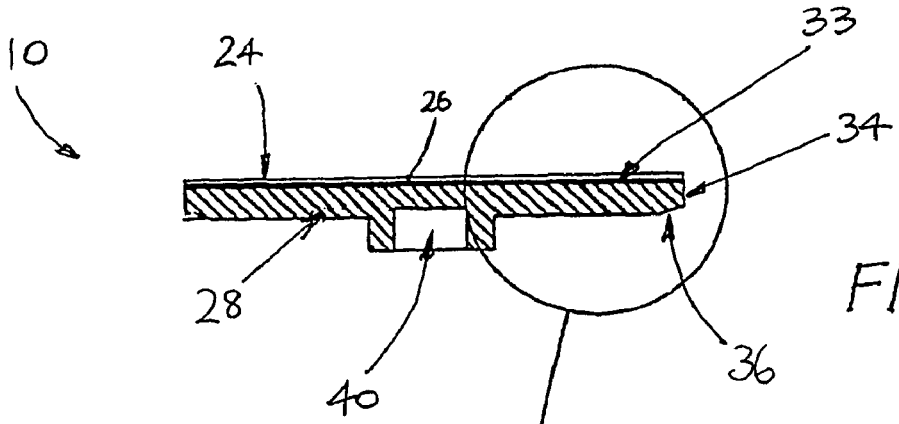
FIG. 6 shows a sectioned side view of the embodiment of FIG. 3.
Figure 6A:
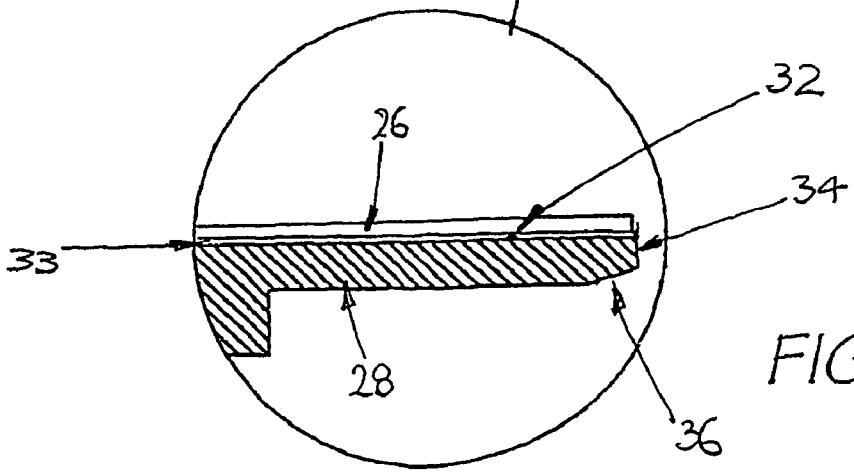
FIG. 6*a* shows a detail of the embodiment of FIG. 6.

Referring to FIGS. 1 and 2 a distributor plate 10 is shown for use in an impelling rotor of a vertical shaft impactor 14. Typically the impelling rotor is a chamber 12 having a circular top plate 16 and a bottom plate 18, with several support posts 20 located near the circumference of the plates 16, 18. The posts 20 join the top plate 16 to the bottom plate 18 and space the plates 16, 18 apart. The rotor chamber 12 is arranged to rotate about a vertical axis A-A (FIGS. 1 and 2).

In another embodiment of the invention the posts 20 can be replaced by discrete wall portions which have a generally elongate vertical and horizontal dimension, the space between these walls defining portals in the side wall of the chamber.

In the preferred embodiment shown, feed materials for breakage are gravity-fed into the rotating chamber 12 via an entry port 22 located in the upper plate 16. Typical feed materials include rock, gravel, mineral ores, metalliferous slags, glass and the like. These relatively coarse materials pass into the rotor chamber 12 and contact or strike the rotating distributor plate 10 which is located at the base of the rotor chamber 12. The materials slide across the distributor plate 10 and are ejected radially out from the rotor chamber 12 through the spaces between the support posts 20, under centrifugal force. The materials impact the surrounding walls 21 of the impactor (or wall-mounted anvils or other rocks located within the impactor walls 21) and are broken apart or attritioned.

In further embodiments of the invention the axis of rotation of the impelling rotor can be located on any angle from the vertical up to and including a horizontal axis. In any embodiment it is possible that the feed materials can be passed into contact with the distributor plate by, for example, a pumping arrangement; the feed materials may therefore be suspended in a fluid, such as in a slurry, for example. Such a feeding arrangement may be more important in those embodiments of the invention where gravity-feeding of the apparatus alone is not feasible.

In some embodiments of the invention the impelling rotor can be open ended at the end which receives the feed materials and the "chamber" portion is generally defined as a region adjacent the distributor plate which need not necessarily be enclosed by top and bottom plates. For example in "hammer and anvil" type impactors the distributor plate is usually held in position by a lower peripheral lip thereon which is interlocked underneath several "hammer" elements of a wear resistant material arranged around the perimeter of the distributor plate; in such apparatus the hammer elements are not necessarily connected to any circular top plate to define a rotor chamber.

In the present invention the distributor plate 10 is removeable for servicing, replacement etc. In one embodiment, the plate has a substantially planar single-piece upper surface 24 onto which the feed materials are received. This substantially flat surface 24 facilitates rapid and easy expulsion of feed materials from the rotor chamber 12. In a plan view the flat surface 24 shown is circular, having a diameter substantially equivalent to the width of the entry port 22. In further embodiments the distributor plate can be of a different diameter to the width of the entry port 22.

In known rotor devices the upper surface of the distributor plate is commonly conical, or is sloped radially downwardly from a peak height located at the centre of the distributor plate at the centreline A-A of the rotor. The centre of such distributor plates includes a hole for placement of a centre bolt which fastens the distributor plate to the rotor. In these known devices the distributor plate commonly has a two or more part upper surface including a central conical portion and an annular peripheral portion joined to the central conical portion, with the peripheral portion being more gently sloped radially outwardly than the conical portion. In such devices the conical portion is inserted for protecting the centre bolt, the conical portion usually having an upper surface which includes wear resistant materials.

The use of a substantially flat distributor plate 10 ensures that the centre of the rotor is less liable to blockage during use because the volume of available space in the rotor chamber is larger than that of existing devices. Such less obstructive geometry can allow an easier passage of higher volumes of feed material, or feed materials which have a coarser overall particle size. Use of a single-piece upper surface of the distributor plate 10 also will not result in the development of preferential wear sites at corners, edges, join lines etc, as can happen with the known distribution plates that have two or more parts which form an upper surface thereof.

In the preferred embodiment the upper surface 24 of the distributor plate 10 is defined by a plate 26 formed from a material resistant to wear and abrasion, such as a metal carbide, for example, tungsten carbide, or indeed a sprayed carbide or a hard ceramic. However, the upper surface 24 may also be treated to be hardened. In such an instance a special hardening process can be carried out on the distributor plate upper surface 24 before it is placed into service. The base portion 28 of the distributor plate 10 is typically made of a less expensive material, such as mild steel, although other typical examples can include aluminium, brass, high density polyethylene, or other hard plastics. In the embodiment shown in the drawings, the metal carbide wear plate 26 is in the form of a thin circular disc which is positioned on and affixed to the upper surface of a thicker distributor plate base portion 28. The wear plate 26 is positioned on the base portion 28 to cover an upper surface of the base portion 28 onto which feed material would otherwise be received during use of the apparatus, to reduce undue wear of the base material necessitating replacement of the entire distributor plate 10.

When the term "substantially planar" is used in this specification it is broadly defined to include surfaces which exhibit unavoidable manufacturing irregularities or surface imperfections, scratches, spotting, minor ridges which can result from a metal forming process.

The wear plate 26 is located on the flat upper surface of the base portion 28 by an upwardly projecting preferably circumferential lip 30 which has a typical height of around 15-20% of the depth of the wear plate 26. In other embodiments the circumferential lip 30 may only comprise a partial circumferential lip, or perhaps only two or three upwardly oriented protruding tabs spaced inset from and/or around the upper edge of the base portion etc. Similar projections may instead extend downwardly from a lower surface of wear plate 26. Any type of locating means is within the scope of the invention to retain the wear plate 26 on the upper surface of the base portion 28 of the distributor plate 10.

Further, the base portion 28 need not have a flat upper surface for the wear plate 26 to be seated thereon. For example, the base portion may have a slight conical shape (either convex or concave) to be mated with a corresponding shape on the underside of the wear plate. In any of these examples, the upper surface of the wear plate can still be provided with a substantially planar or flat upper surface so that the distributor plate has a substantially planar upper surface in use.

When mounting the wear plate 26 on the base portion 28 to form distributor plate 10, the wear plate 26 is typically spaced from the base portion 28 by a spacing means in the form of an upwardly oriented ring 32 located on or formed at the upper surface of base portion 28. The ring 32 is concentric about the centre of the distribution plate 10 located at the vertical axis A-A and is inset from the peripheral edge 34 of the base portion 28. More than one ring can be employed on the upper surface of the base portion and typically the ring(s) are around 0.5 mm in height. Ring 32 provides for a predetermined depth of an adhesive substance 33 which is used in the distributor disc assembly process to join the base portion 28 and the wear plate 26, typically the optimum amount of adhesive as recommended by the adhesive manufacturer.

In further embodiments of the invention the spacing ring(s) may only comprise a partial ring, or perhaps only several spaced apart upwardly oriented surface projections (e.g. dimples) located on the upper surface of the base portion. Alternatively, the ring may be located on an underside of the wear plate. Any type of spacer that provides a predetermined depth of an adhesive substance to retain the wear plate on the upper surface of the base portion of the distributor plate is within the scope of the invention.

In embodiments of the invention where an adhesive substance is not required to join the wear plate to the distributor plate base portion, there is no requirement for there to be spacing rings (or any other surface projections) on the upper surface of the base portion or on the lower surface of the wear plate. In such examples the wear plate can be spray-applied, welded, brazed or otherwise fused to the distributor plate base portion so that there is a direct bond between the adjacent surfaces of the wear plate and the base portion.

Depending upon the diameter of the distributor plate and the thickness of the wear plate, the distributor plate can be quite heavy and cumbersome to manipulate, requiring the use of a levering tool, or perhaps even a number of tools used simultaneously and spaced around the plate 10.

The lower peripheral edge of the base portion of the distributor plate 10 is typically bevelled 36 in at least one position, so that a levering tool such as a screwdriver can be inserted to facilitate lifting and grasping of the distributor plate 10 by hand for rotation into a different wear position, or for servicing or replacement entirely. In a preferred embodiment the entire lower peripheral edge is bevelled.

Alternatively, a number of discrete bevelled portions in the lowermost peripheral edge of the distributor plate can be employed.

In a preferred embodiment the distributor plate 10 has a basal spigot 38 provided with a downwardly facing cavity 40. The cavity is arranged to receive a coupling bolt 42 therein when the plate 10 is mounted in chamber 12. The coupling bolt is used to fasten the bottom plate 18 of the chamber 12 (or other member linked to the bottom plate 18) to a rotatable vertical shaft 44 of the vertical shaft impactor 14. The cavity 40 in the spigot 38 can be of any shape or dimension to suit the particular requirements of a coupling bolt 42 or any other fastening device used to attach the chamber 12 to the shaft 44. In some examples where the chamber 12 is fastened to the shaft by another fastening arrangement other than a central coupling bolt, the cavity 40 in the spigot 38 may not be required to accommodate a fastening device and may in fact be empty when in use. The spigot 38 can be of any suitable outer shape, and in a preferred embodiment is a hexagonal prism shape.

Referring to FIGS. 3 to 4A and FIGS. 5 to 6A, where like reference numerals are used to denote similar or like parts, it will be seen that wear plates 26 and base portions 28 of varying thicknesses can be employed. For example, a thinner distributor plate can be used for less abrasive or lighter feed materials.

Figure 7:
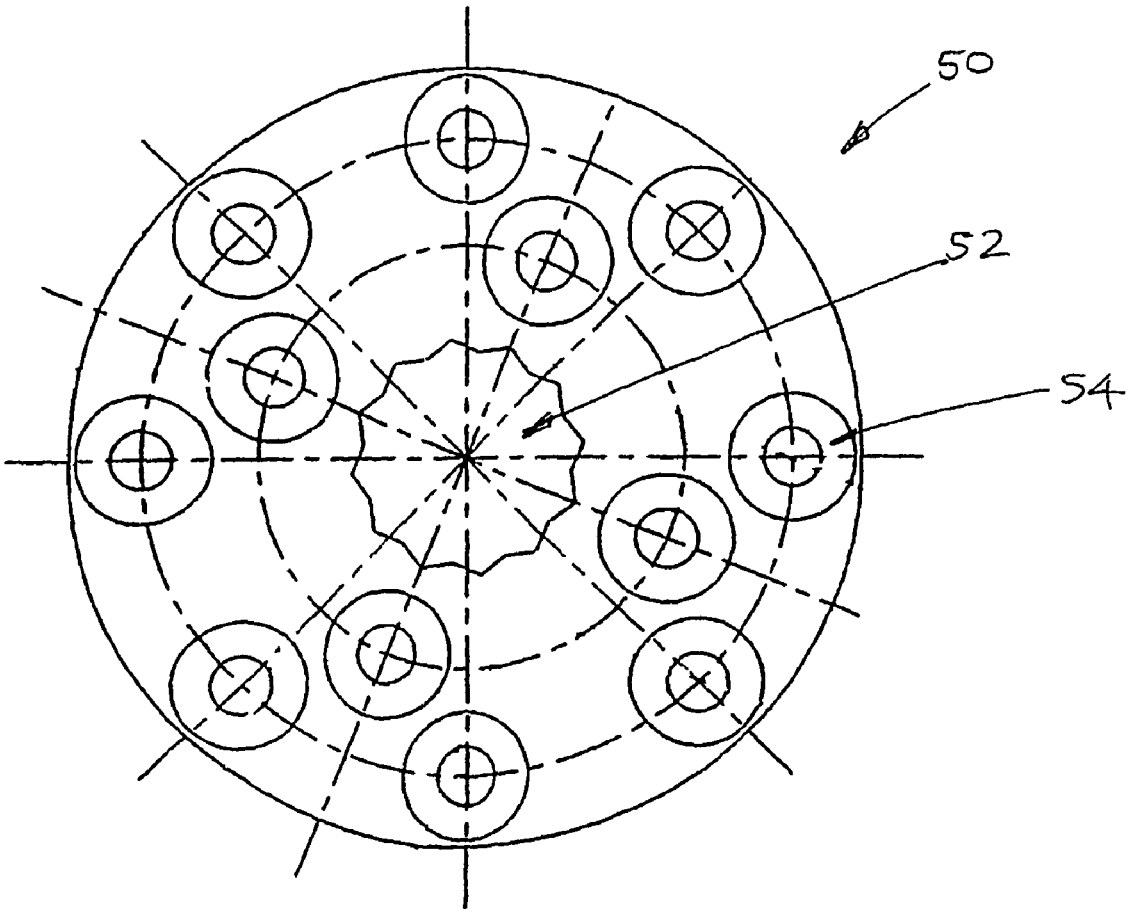
FIG. 7 shows a plan view of one embodiment of a support plate for supporting a distributor plate of an impelling rotor of a vertical shaft impactor in accordance with the invention.

Referring in particular to FIGS. 1 and 7, a support plate 50 is used in the vertical shaft impactor 14 to support the distributor plate 10. The support plate has a multi-sided central recess 52 (in this case, a through-hole) for the insertion thereinto of a multi-sided basal spigot 38. The number of sides of the hole 52 in the support plate 50 is typically defined to be a multiple of the number of sides of the spigot 38. In a preferred embodiment, the hole in the support plate is a polygon with, in effect, twenty four "sides" (being a twelve pointed star shape). The basal spigot has six sides, and has a hexagonal prism shape.

In a preferred embodiment, where there are three posts 20 in the impactor rotor chamber 12 (and therefore three spaces between the support posts 20 from which feed materials may be radially ejected from the spinning rotor chamber 12), it is possible to move (rotate) the distributor plate 10 with respect to the support plate 50 into four different "wear" positions, to spread the abrasive wearing of the metal carbide evenly over the wear plate 26 over time, rather than only having a limited number of grooves worn into the wear plate 26. The number of possible wear positions can thus be determined by the number of polygonal corner points or star tips of the hole in the support plate So divided by the number of material outlet spaces from the rotor chamber 12.

For example, in the instance where a six sided polygonal hole in the support plate receives a six sided basal spigot, in a chamber where there are three feed outlet spaces, the distributor plates is only moveable into two "wear" positions, which is rather limited. Having polygonal holes in the support plate of, say, 9, 12 or 15 sides means that, in a rotor chamber utilising three outlet spaces between support posts, there are 3, 4 or 5 respective possible wear positions for the distributor plate 10 to be moved into. It is also possible to produce rotor chambers having 3, 4, 5 or even 6 outlet spaces.

FIG. 7 also shows a number of recessed bolt holes 54 in the support plate 50 which are used to attach plate 50 via bolts 56 (FIG. 1) to a boss 58. Boss 58 is located to surround an upper end of the vertical shaft 44 on which the rotor body 12 sits (FIG. 1), and can also be attached to the base plate 18 of the rotor body 12 itself. The boss 58 has a tapered hole 60 to match a corresponding taper on the vertical shaft 44. Any number, array or position of recessed bolt holes 54 for attaching the support plate to boss 58 is within the scope of the present invention.

In other embodiments the distributor plate can also be attached to any part of the rotating impactor assembly including base 18 by the use of bolts for receipt into corresponding holes in the base, or any other joining mechanism. Other joining plate types are within the scope of the invention and the particular arrangements illustrated in FIG. 1 and FIG. 7 are only one way of attaching the support plate and rotor body to the rotatable shaft.

Figure 8:
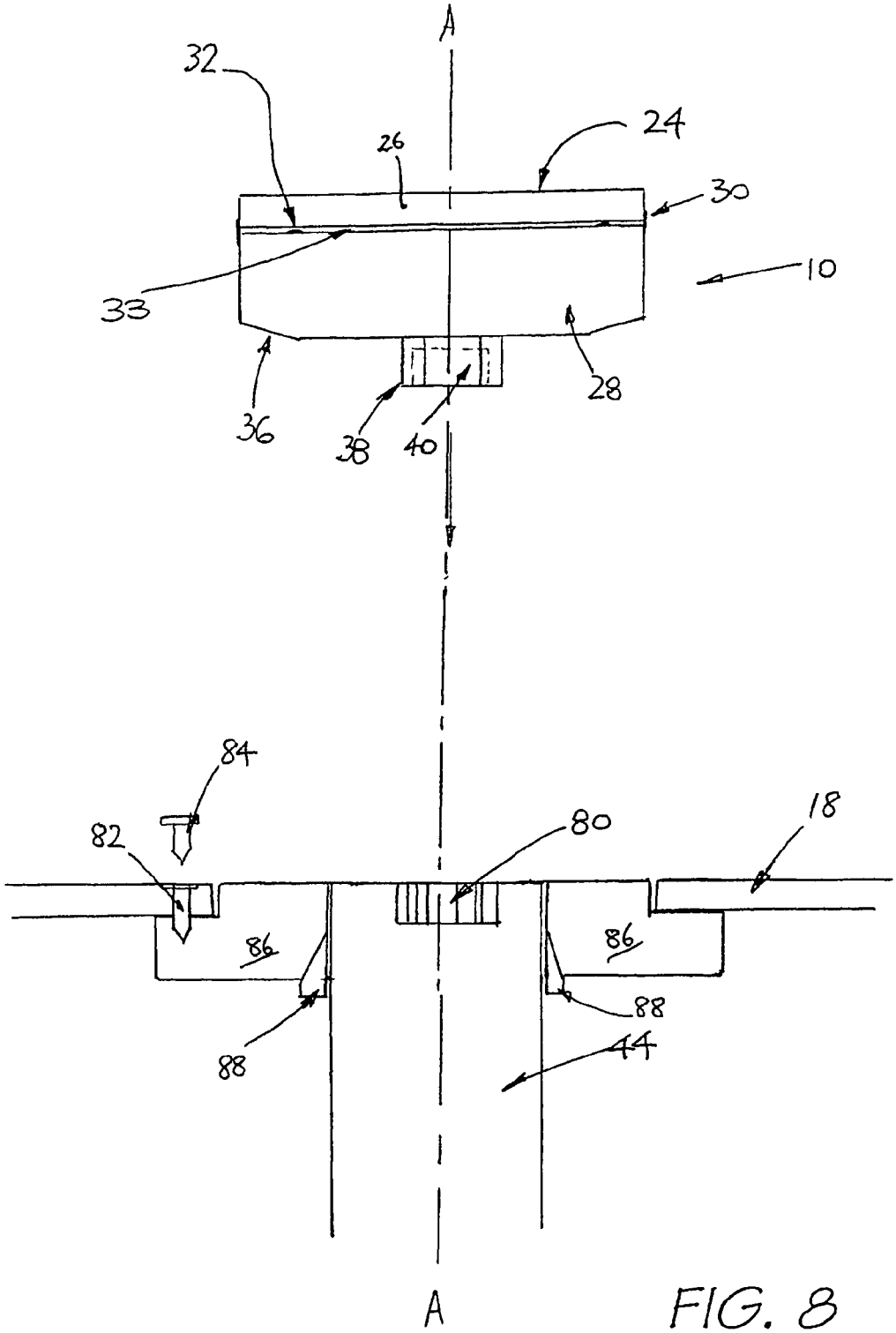
FIG. 8 shows an exploded partly sectioned side view of one embodiment of a distributor plate for an impelling rotor of a vertical shaft impactor in accordance with the invention.

In still further preferred embodiments the distributor plate 10 can be attached directly to the shaft 44 of the rotor which rotates about vertical axis A-A. Referring to FIG. 8, where like reference numerals are used to denote similar or like parts used in previous embodiments, the rotor shaft 44 itself can have a multi-sided central recess 80 for the insertion thereinto of the multi-sided basal spigot 38 of the distributor plate 10. Once again the number of sides of the recess 80 in the shaft 44 is typically defined to be a multiple of the number of sides of the spigot 38. In a preferred embodiment, the recess 80 in the shaft can be a polygon with, in effect, twenty four "sides" (being a twelve pointed star shape) to be used with a basal spigot 38 with six sides, and of a hexagonal prism shape.

FIG. 8 also shows a number of recessed bolt holes 82 in the bottom plate 18 which can be used to attach this plate via bolts 84 to a boss 86. Boss 86 is located to surround an upper end of the vertical shaft 44 on which the base plate 18 of the rotor body 12 sits. Any number, array or position of recessed bolt holes 82 for receiving bolts 84 to attach the base plate 18 to boss 86 is within the scope of the present invention. Furthermore the boss 86 can be attached to the vertical shaft 44 by means of a taper lock bearing 88 fitted about the shaft 44. Other devices for joining the boss to the shaft and the base plate of the rotor body to the boss are within the scope of the invention and the particular arrangements illustrated in FIG. 8 are only one preferred example. In further embodiments, grub screws or external clips, for example, can be used to join the component parts together.

In use the distributor plate can be moved into various wear positions (as held by the support plate or the rotor itself) by an operator to minimise the uneven nature of wear of the metal carbide wear plate 26. In turn such a facility enables thinner metal carbide wear plates to be used in such apparatus (see e.g. FIGS. 4, 4A and 6, 6A) which reduces the unit cost and weight of the distributor plates. The use of a distributor plate with a basal spigot to "fasten" the distributor plate into the rotor chamber 12 eliminates the need to have a central axial fastening bolt in the top of the distribution plate (an adverse feature of known apparatus, normally necessitating a conical or peaked cap of metal carbide being placed over the central fastening bolt after fitting during use of the impactor rotor; uneven wearing due to some slight dislodgement of a prior art metal carbide cap, in addition to the blocking of the rotor chamber itself with feed materials, can commonly be the result).

The performance and maintenance requirements of impactors are affected by the cost of parts and how frequently they have to be changed. A reduced frequency of servicing and maintenance intervals combined with safer and easier changing of machine parts and a lower consumption of expensive, wear resistant materials can lead to lower materials breakage or processing costs overall.

The materials of construction of the distributor plate and the support plate can be any suitable materials which wear appropriately and that can be shaped, formed and fitted in the manners so described, such as the appropriate metal, metal alloys, ceramics or plastics etc, referred to already. The support plate does not need to be especially hardened or be made of very strong materials and can be formed from lighter weight metals such as aluminium or hard plastics and the like.

It is to be understood that, if any prior art information is referred to herein, such reference does not constitute an admission that the information forms a part of the common general knowledge in the art, in Australia or any other country.

Whilst the invention has been described with reference to preferred embodiments it should be appreciated that the invention can be embodied in many other forms.

That which is claimed is:

1. A distributor plate for an impelling rotor of a rotating shaft impactor, where the impelling rotor is a chamber arranged in use to rotate about an axis of a rotor shaft and to radially eject material received therein through one or more ejection ports in a side wall of the chamber, the distributor plate being in use held in a fixed position with respect to the impelling rotor, wherein the distributor plate consists of a single base portion including a central portion having a substantially planar continuous upper surface and a single wear element comprising a substantially planar circular disc including a central portion, the single wear element being positioned on and affixed to the upper surface to alone entirely cover the upper surface of the base portion including the base portion central portion onto which the material would otherwise be received.

2. A distributor plate as claimed in claim 1 wherein the wear element is made of a wear resistant material.

3. A distributor plate as claimed in claim 1 wherein the base portion includes a projection at its peripheral edge which is used to locate the wear element on the upper surface of the base portion.

4. A distributor plate as claimed in claim 3 wherein the projection is a peripheral lip.

5. A distributor plate as claimed in claim 1 wherein the wear element is spaced from the base portion by one or more spacers arranged between the upper surface of the base portion and a mating surface of the wear element so that, when the wear element is attached to the base portion by use of an adhesive substance, the spacer(s) provide a predetermined depth of the adhesive substance between the base portion and the wear element.

6. A distributor plate as claimed in claim 5 wherein one such spacer is a projecting ring on the base portion, concentric with a central axis of the base portion and inset from the peripheral edge of the base portion.

7. A distributor plate as claimed in claim 1 wherein a lower peripheral edge of the base portion is bevelled in at least one position, the bevelled edge adapted for the insertion of a levering tool to facilitate movement of the distributor plate.

8. A distributor plate as claimed in claim 7 wherein the entire lower peripheral edge is bevelled.

9. A distributor plate as claimed in claim 1, wherein the upper surface of the base portion has a constant thickness throughout.

10. A distributor plate as claimed in claim 1, wherein the base portion has a basal spigot provided with a downwardly facing cavity, the cavity being arranged to receive a coupling bolt therein when said plate is mounted in the chamber.

11. A distributor plate as claimed in claim 1, wherein the base portion has a multi-sided basal spigot adapted for insertion into a multi-sided central recess of the rotor shaft.

12. A distributor plate according to claim 11, wherein a number of sides of said recess is a multiple of a number of sides of said spigot.

13. An impelling rotor of a rotating shaft impactor including a distributor plate for the impelling rotor, wherein the impelling rotor is a chamber arranged in use to rotate about an axis of a rotor shaft and to radially eject material received therein through one or more ejection ports in a side wall of the chamber, the distributor plate being held in a fixed position with respect to the impelling rotor, wherein the distributor plate consists of a single base portion including a central portion having a substantially planar continuous upper surface and a single wear element comprising a substantially planar circular disc including a central portion, the single wear element being positioned and affixed to the base portion to alone entirely cover the upper surface of the base portion including the base portion central portion onto which the material would otherwise be received.

14. A rotating shaft impactor including a distributor plate for the impelling rotor, wherein the impelling rotor is a chamber arranged in use to rotate about an axis of a rotor shaft and to radially eject material received therein through one or more ejection ports in a side wall of the chamber, the distributor plate being held in a fixed position with respect to the impelling rotor, wherein the distributor plate consists of a single base portion including a central portion having a substantially planar continuous upper surface and a single wear element comprising a substantially planar circular disc including a central portion, the single wear element being positioned and affixed to alone entirely cover the upper surface of the base portion including the base portion central portion onto which the material would otherwise be received.

* * * * *